US005174671A

United States Patent [19]

Pawlak et al.

[11] Patent Number: 5,174,671

[45] Date of Patent: Dec. 29, 1992

[54] PRINTING MECHANISM WITH PRINT HAMMER HAVING NOISE DAMPENER

[75] Inventors: Stephen M. Pawlak, Cortland; Roger J. Rimbey, Spencer; Donald G. Anderson, Jr., Locke, all of N.Y.

[73] Assignee: Smith Corona Corporation, Cortland, N.Y.

[21] Appl. No.: 783,482

[22] Filed: Oct. 28, 1991

[51] Int. Cl.[5] ..... B41J 19/04; B41J 29/10

[52] U.S. Cl. ..... 400/689; 248/638; 101/93.48

[58] Field of Search ..... 400/689, 656; 101/93.48, 93.02; 248/632, 634, 38

[56] References Cited

U.S. PATENT DOCUMENTS

| | | | |
|---|---|---|---|
| 1,615,976 | 2/1927 | Going | 400/689 |
| 2,157,607 | 5/1939 | Hart | 400/689 |
| 4,318,452 | 3/1982 | Reitner | 400/689 |
| 4,327,639 | 5/1982 | Crystal et al. | 101/93.48 |
| 4,754,827 | 7/1988 | Hirabayashi | 248/638 |
| 4,987,679 | 1/1991 | Rau | 248/638 |

FOREIGN PATENT DOCUMENTS

| | | | |
|---|---|---|---|
| 3603816 | 4/1987 | Fed. Rep. of Germany | 101/93.02 |
| 0100091 | 6/1982 | Japan | 400/689 |
| 0113565 | 5/1987 | Japan | 400/689 |

OTHER PUBLICATIONS

"Acoustic Isolation of a Print Hammer Head from a Print Hammer Body" IBM Technical Disclosure vol. 28 No. 10 Mar. 1986.

*Primary Examiner*—Edgar S. Burr
*Assistant Examiner*—Lynn D. Hendrickson

[57] ABSTRACT

A printing device including a print hammer having a noise dampener for use with an impact printer mechanism. The print hammer has a significant mass for impacting a character pad against an ink ribbon, paper and a platen. In a first embodiment the print hammer includes an acoustic noise dampening layer interposed between a mass weight and the hammer face which carries the anvil that impacts during printing. In other embodiments the print hammer is formed in two parts. One part having a weighted mass and the other part being pivotally coupled to the printer mechanism. The two parts are structurally joined together by a noise dampening member. Transmission of acoustic noise during impact printing through the hammer is reduced.

13 Claims, 4 Drawing Sheets

PRINTING MECHANISM WITH PRINT HAMMER HAVING NOISE DAMPENER

CROSS-REFERENCE TO RELATED APPLICATIONS

There are no related applications.

STATEMENT AS TO RIGHTS TO INVENTION MADE UNDER FEDERALLY SPONSORED RESEARCH AND DEVELOPMENT

The invention disclosed and claimed herein was not made under any federally sponsored research and development program.

BACKGROUND OF THE INVENTION

1. Field of the Invention

The present invention relates generally to impact printing mechanisms used in printing devices such as typewriters and printers and more particularly to a print hammer used in such a mechanism which dampens acoustic noise generated during operation of a printing mechanism.

2. Description of the Prior Art

Both typewriters and printers utilizing impact printing mechanisms often generate high levels of acoustic noise. There have been various solutions proposed to lower the noise generated by such printing mechanisms. It has, for example, been the practice in the typewriter and printer art to reduce noise by the use of platens having a reduced hardness. This solution has, however, been found to also reduce the print quality. Another practice has been to reduce the required impact velocity by increasing the effective or apparent mass of the hammer or anvil.

Increasing the effective mass of the print hammer allows reduction of impact velocity to attain equivalent print quality. A weighted hammer, however, like conventional hammers, does contribute to coupling the acoustic noise generated during impact, back through the print drive assembly.

Other solutions to the foregoing problem include noise dampening structures and materials for use in impact printing mechanisms. For example, U.S. Pat. No. 4,318,452 discloses a dampening material interposed between a support beam and a metal strip. The strip receives the impact of typewriter typebars and other noise inducing mechanical force elements of printing. The noise emanating from the impacts is dampened as it travels through the material. Also, U.S. Pat. No. 1,615,976 discloses a typebar which includes a shock absorbing means. Shock absorbing material is disposed between a "U" shaped member and the typebar whereby the shock impact energy is absorbed when movement of the typebar is arrested at impact during the print cycle. In addition, U.S. Pat. No. 2,157,607 discloses a typebar abutment which includes an arcuate cage and a plurality of filler plates tightly filling the cage. The plates are spaced apart by air films and function to interrupt and dampen sound waves generated when the typebars strike the abutment to thereby reduce the impact noise.

SUMMARY OF THE INVENTION

The purpose of the present invention is to provide a quiet impact printing mechanism to be used in a typewriter or printer. The present invention comprises an acoustically dampened print hammer of a printer mechanism. The printer mechanism is supported on a pivotal bracket carried on a horizontally movable carrier. The weighted print hammer is pivotally supported for movement toward and away from a platen. In one embodiment the print hammer includes a hammer face plate which carries an anvil on its upper face and includes a pivot structure at its lower portion. The hammer also includes a mass weight and a noise dampening layer disposed intermediate the mass weight and the rear print hammer face. Transmission of acoustic noise generated on impact of the anvil during printing is reduced by being absorbed by the dampening layer.

In a second and third embodiment the print hammer is formed with an upper portion which includes a weighted mass and anvil and a lower pivot portion. The upper and lower hammer portions are joined together by an acoustic dampening means.

Accordingly, it is an object of this invention to provide an impact printer mechanism having an acoustically dampened print hammer for an impact printer mechanism used in conjunction with a typewriter or printer.

Another object of this invention is to provide a low cost, simple impact printer mechanism having an acoustically dampened print hammer for isolating noise generated during printing from the printer mechanism and which is readily assembled and consists of a reduced number of components.

Other objects and many of the attendant advantages of this invention will be readily appreciated as the same becomes better understood by reference to the following detailed description when considered in connection with the accompanying drawings in which like reference numerals designate like parts throughout the figures thereof.

DETAILED DESCRIPTION OF THE PREFERRED EMBODIMENTS

Figure 1:
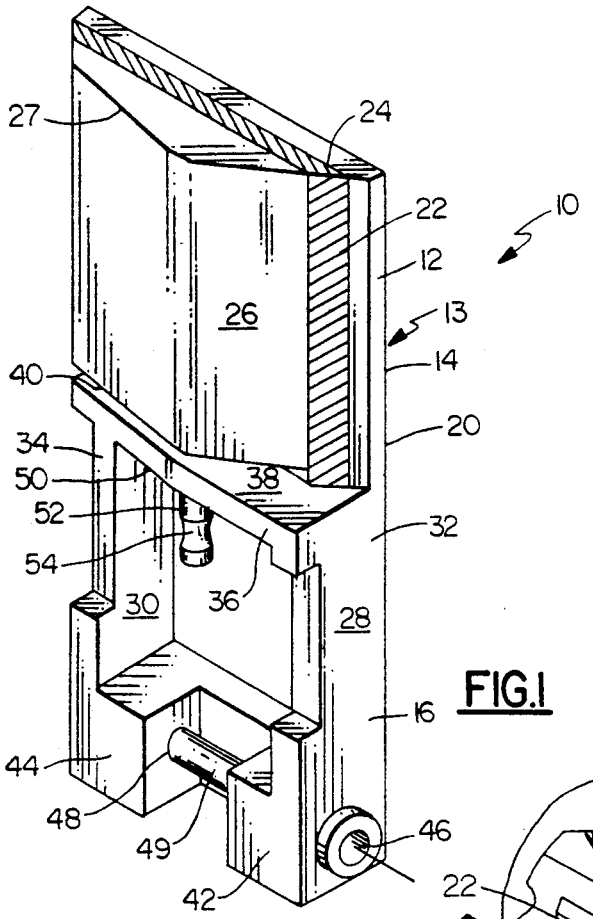
FIG. 1 is a front left side perspective view of a print hammer constructed in accordance with the present invention.
Figure 2:
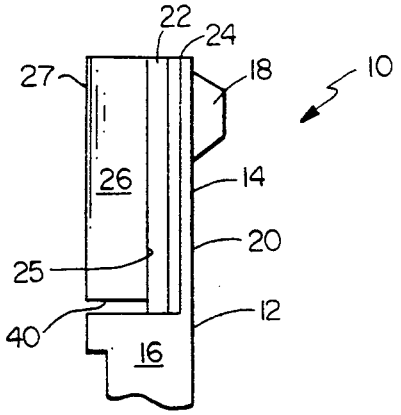
FIG. 2 is a partial side elevation view of the print hammer of FIG. 1.

In the illustrated embodiment of FIGS. 1 and 2 an acoustically noise dampened print hammer 10 includes a front face plate 12. The front face plate 12 Comprises an upper plate portion 14 and a lower, pivot portion 16. Upper plate portion 14 carries an outwardly directed anvil 18 on its outer face 20. A printing impact portion 13 of print hammer 10 includes the front face plate 12 which may be metallic. A noise dampener layer 22 is affixed to the rear face 24 of upper plate portion 14 and to the forward face 25 of mass weight 26 so as to be sandwiched between the upper plate portion 14 and mass weight 26. The mass weight 26 is formed with the face or plate 25 having a surface projecting a plurality of letter spaces in a plane parallel to a platen. The mass weight 26 is also formed with a varying depth 27 (FIG. 1) behind the face 25 having a maximum dimension substantially behind the anvil 18.

Having acoustic dampening material cemented to the print hammer, dampens vibration within the print hammer itself resulting in a substantial reduction in the noise emitted from the body of the hammer as well as minimizing vibration transmitted to the print drive assembly which results in further noise reduction.

Various noise dampening layer materials include an elastomeric material designated as C-1002 manufactured by E-A-R Specialty Composites located in Indianapolis, Ind. A means for affixing the noise dampener layer 22 is by adhesively cementing noise dampener layer 22 between rear face 24 and forward face 25. A suitable pressure sensitive adhesive and affixing means is an acrylic adhesive designated as 550 PSH distributed by E-A-R Specialty Composites. Such a sandwiched structure provides what is generally described as constrained layer dampening. The mass weight 26 and the noise dampener layer 22 are disposed behind and in alignment with the anvil 18 for absorption of acoustic noise generated by printing impact.

The lower pivot portion 16 of the print hammer 10 comprises a pair of spaced apart depending legs 28 and 30 which are joined at their upper ends 32 and 34 by horizontal ledge 36 whose upper face 38 is spaced from the base 40 of mass weight 26. The lower ends 42 and 44 of legs 28 and 30 are formed with aligned transverse openings 46 and 48 which receive a tubular shaft 49 about which the print hammer ac pivots as will be described hereinafter with reference to FIG. 3. Depending from the lower face 50 of ledge 36 is a vertically centered shaft 52 having an annular groove 54.

Figure 3:
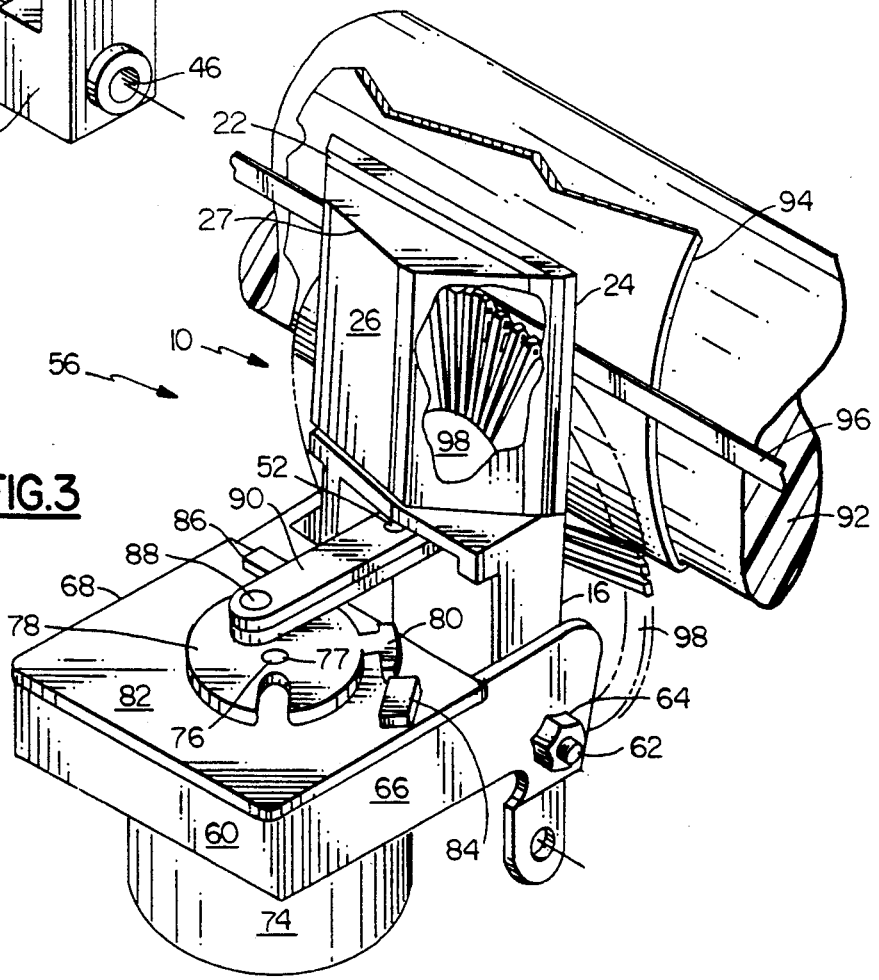
FIG. 3 is a front right side perspective view of a printer mechanism including the print hammer of FIG. 1 constructed in accordance with the present invention.

With reference to FIG. 3, there is shown a low noise impact printer 56 which incorporates the print hammer 10 of FIGS. 1 and 2 and includes a bracket 60 which is pivotally supported on a horizontally movable carrier (not shown) by pins 62 (only one shown). The pins 62 extend through openings 64 in opposite bracket walls 66 and 68 and corresponding openings in the carrier. Screw pins 62 which extend through openings 64 of bracket 66 also extend through tubular shaft 49 for joining bracket 66 with tubular shaft 49. In this manner, print hammer 10 is pivotable about tubular shaft 49.

The bracket 60 also supports a reversible D.C. electric motor 74 between opposed walls 66 and 68. This motor 74 is provided with electrical contacts (not shown) so that when voltage of one polarity is applied, the motor shaft will rotate in one direction and when the polarity is reversed the motor shaft 76 will rotate in the opposite direction.

A rotary member 78 is mounted for rotation on the upper end of motor shaft 76 and rotary member 78 includes an outwardly extending "T" shaped stop so which serves as a stop. Supported on the upper face 82 of bracket 60 are a pair of stop abutments 84 and 86 for limiting the angular rotation of rotary member 78. The motor shaft 76 extends into a central bore 77 of rotary member 78 whereby rotary member 78 is rotated by motor shaft 76. Rotary member 78 carries an upwardly extending coupling pin 88 which rotates about central bore 77.

A link arm 90 is coupled to pin 88 and translates the rotary movement of the member 78 to linear reciprocating movement of the shaft 52 resulting in pivoting movement of the mass weight 26 about tubular shaft 49. Pivoting movement of the print hammer 10 moves the hammer toward and away from a platen 92.

Figure 5:
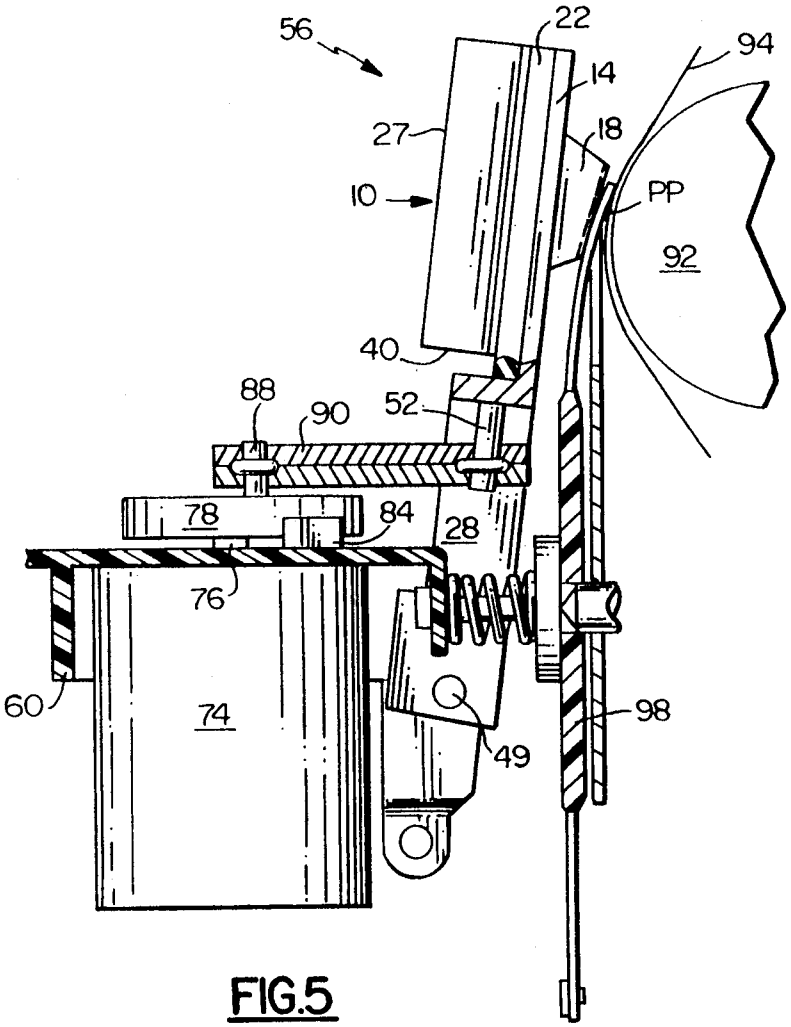
FIG. 5 is a view similar to that of FIG. 4 except with the print hammer at the print point during impact.
Figure 4:
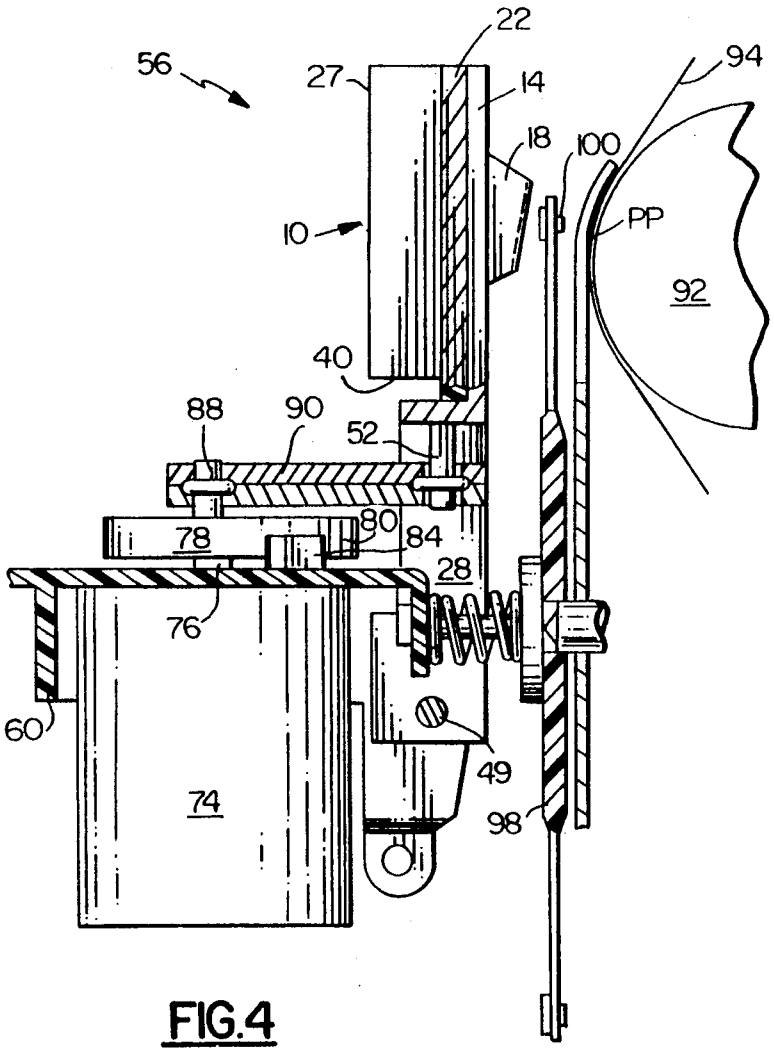
FIG. 4 is a right side sectional elevational view taken along the vertical center line of the printer mechanism of FIG. 3 with the print hammer in the rest position.

As shown in FIGS. 4 and 5, the printer 56 or typewriter in which the noise dampening print hammer 10 is used includes the platen 92. Supported between the platen 92 and print hammer 10 is an image print medium 94 such as a paper sheet, an ink ribbon 96 (see FIG.3) and a print element 98 such as a daisy print wheel. The print element 98 is controlled for selected rotation to present a selected character pad 100, carried at the free end of the print element 98, at the typewriter print point PP.

FIG. 4 shows the print hammer 10 at its rest position with "T" shaped stop so against stop abutment 86 (not shown).

When a key on the keyboard is depressed, the print element 98 is rotated so as to locate the character pad 100, designated by the depressed key, in position for printing. At approximately the same time the print element 98 is rotated, motor 74 is energized for rotation of the rotary member 78 in a clockwise direction. As the rotary member 78 rotates in a clockwise direction, the pin 88, as the point of connection between the rotary member 78 and the link arm 90, moves concentrically about the motor shaft 76. The link arm 90 is caused to move toward the platen 92. Movement of shaft 52, which is coupled to print hammer 10, causes the print hammer 10 to move toward platen 92. The velocity of the print hammer 10 as it moves toward and away from the platen 92 can be controlled by variation of the voltage/current parameters applied to the motor 74 in known manner.

FIG. 5 illustrates the relative orientation of the various components at the instant that printing occurs, i.e. at the impact of the anvil 18 and character pad 100 against the image print medium 94, ribbon 96, and in turn against the platen 92. The clockwise rotation of rotary member 78 is stopped by the "T" shaped stop so abutting against stop abutment 84. After printing, the motor 74 is energized to rotate in the opposite or counter clockwise direction by reversal of the voltage polarity at the motor terminals. The rotary member 78 reverses rotation and rotates until its "T" shaped stop so engages stop abutment 86 thereby terminating further movement. Stop abutments s and 86 may be of an elastomeric material.

Figure 6:
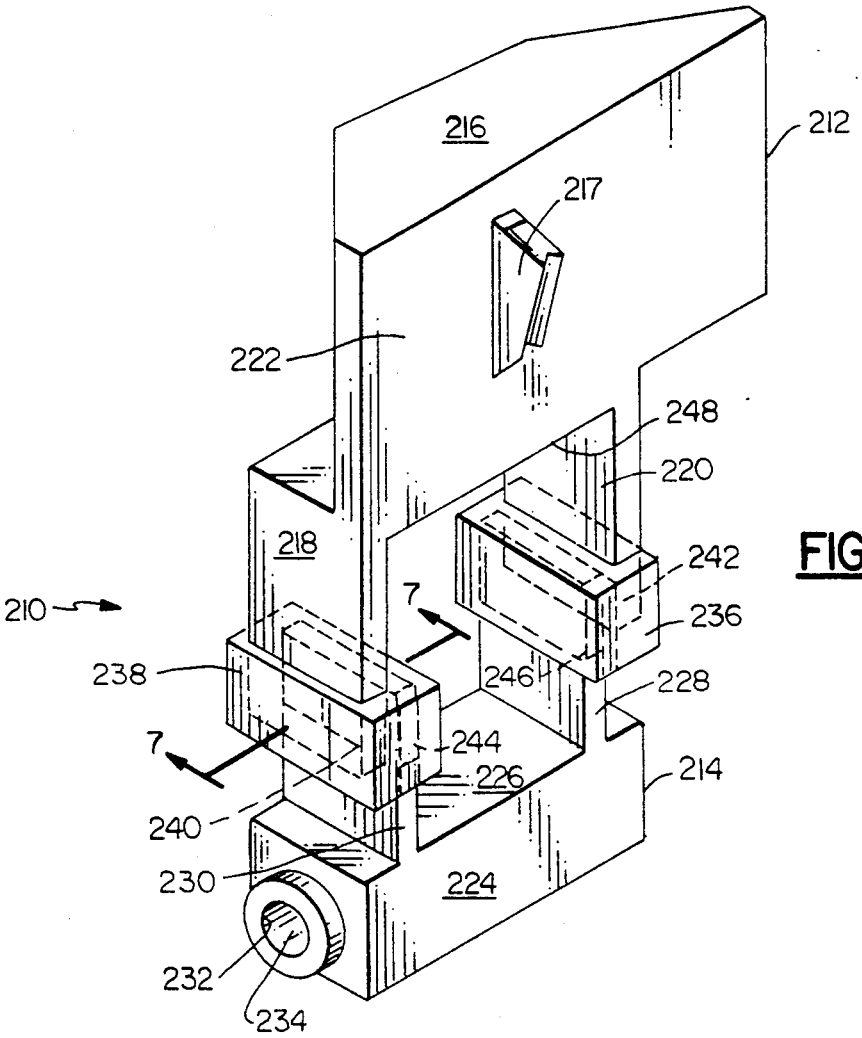
FIG. 6 is a rear perspective view of a second embodiment of a print hammer constructed in accordance with the present invention.
Figure 7:
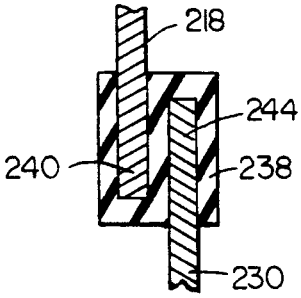
FIG. 7 is a partial sectional view of the print hammer of FIG. 6 taken along line 7—7.
Figure 8:
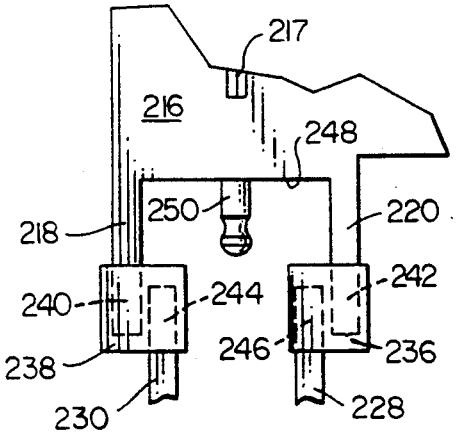
FIG. 8 is a partial side elevational view of the print hammer of FIG. 6.

Illustrated in FIGS. 6, 7 and 8 is a second embodiment of a print hammer 210, made in accordance with the present invention, which hammer includes an upper print portion 212 and a lower pivot portion 214. The upper print portion 212 is formed with a weighted mass 216, a central anvil 217, and a pair of depending legs 218 and 220. Legs 218 and 220 extend laterally from the weighted mass face 222 and are rectangular in horizontal cross-section.

The lower pivot portion 214 is formed with a block portion 224 from whose upper face 226 extend block legs 228 and 230. Block portion 224 is provided with opening 232 which extends lengthwise thereof and is transverse to block legs 228 and 230. The opening 232 can Carry therein a tubular shaft 234 similar to the tubular shaft 49 described above with reference to FIGS. 1 to 3.

The upper print portion 212 and the lower pivot portion 214 are structurally joined together by molded noise damper members 236 and 238 which encase the lower leg ends 240 and 242 of depending legs 218 and 220 and the upper leg ends 244 and 246 of block legs 228 and 230. Having the joined legs 218 and 220 and 228 and 230 parallel to each other along their longer dimension provides increased structural rigidity and higher print quality. The joined legs 218 and 220 encased in members 236 and 238 are separated by a noise dampening material which absorbs acoustic noise. An example of a suitable moldable noise dampening material is the elastomeric material designated as C-1002 manufactured by E-A-R Specialty Composites. The print hammer 210 is provided with a shaft 250 which depends from inner face 248 of upper print portion 212. This shaft 250 corresponds to shaft 52 of the prior described embodiment.

Figure 9:
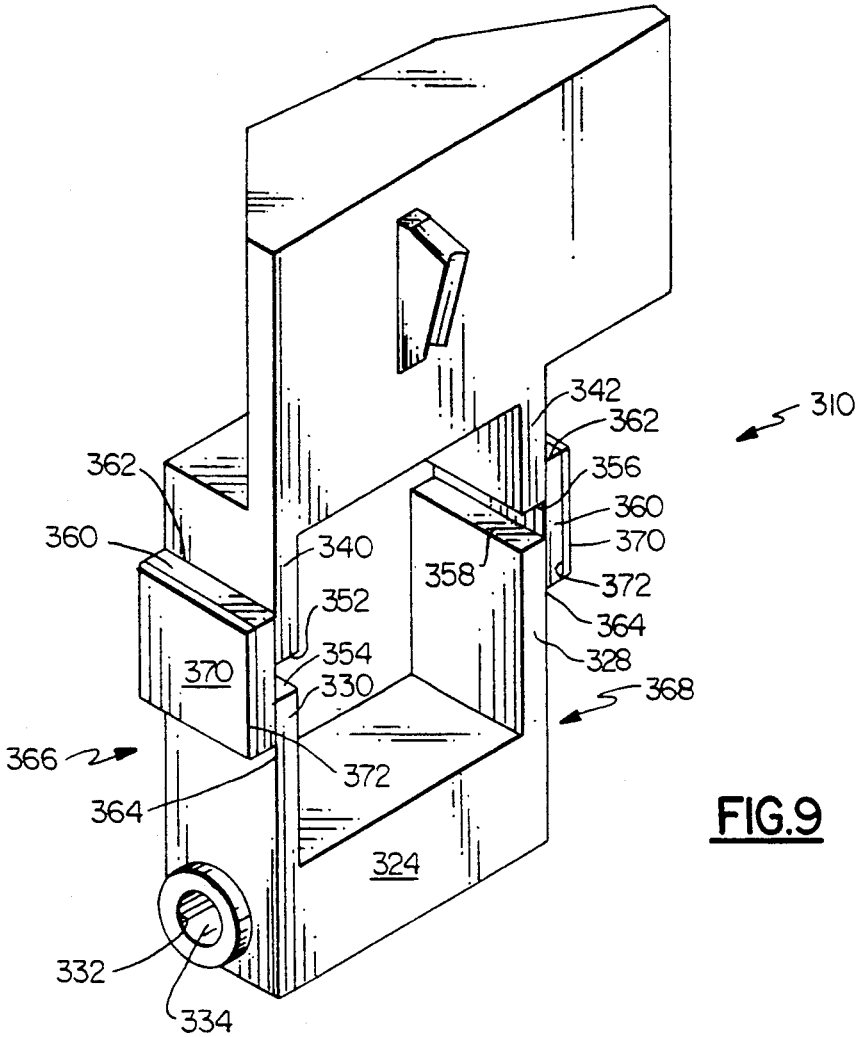
FIG. 9 is a rear perspective view of a third embodiment of a print hammer constructed in accordance with the present invention.
Figure 10:
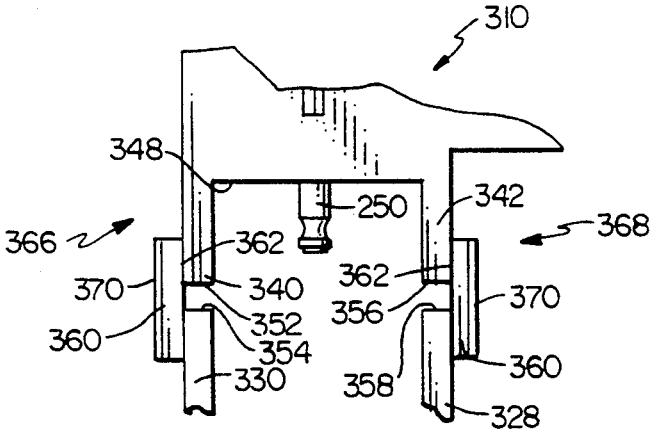
FIG. 10 is a partial side elevational view of the print hammer of FIG. 9.

The third embodiment of a print hammer 310 illustrated in FIGS. 9 and 10 includes block legs 328 and 330 in spaced alignment with spaced print portion legs 340 and 342. In this manner, leg edges 352 of print portion leg 340 and leg edge 354 of block leg 330 face each other as does leg edge 356 of print portion leg 342 and leg edge 358 of block leg 328. An elastomeric noise damper member 360 is affixed as by cementing to outer leg surface 362 and outer leg surface 364 on both sides 366 and 368 of the print hammer 310, with leg edges 352 and 354 and edges 356 and 358 spaced apart. A metal plate 370 is affixed as by cementing to the outer surface 372 of damper member 360 to provide a rigid structural coupling between the upper print portion 312 and block portion 324. An example of a suitable noise dampening material for fabricating the noise dampener member 360 is an elastomeric material manufactured by E-A-R Specialty Composites under the designation C-1002.

All the foregoing described embodiments reduce the printing impact acoustic noise from being transferred to the printer mechanism to provide a quieter printer. The first described embodiment is significantly easier to assemble for mass production, increases production quality and requires only a single damper layer. The embodiment of FIG. 1 also provides greater dimensional stability between the weighted mass (including the anvil) portion and the pivot portion to facilitate mass production and thereby contribute to quality printing.

Obviously many modifications and variations of the present invention are possible in the light of the above teachings. It is therefore to be understood that, within the scope of the appended claims, the invention may be practiced otherwise than specifically described.

Having thus described the invention, what is claimed as novel and desired to secure by Letter Patent is:

1. A printing device having a print element, a platen, a carrier supporting an impact printer mechanism having a print hammer for driving a selected character pad of said print element to print a character on an image print medium supported by said platen, said print hammer comprising:

a printing impact portion including an outwardly directed anvil;

a mass weight includes a plate having a surface projecting a plurality of letter spaces in a plane parallel to said platen and includes having a maximum dimension in a direction perpendicular to said platen substantially behind said anvil; and a noise dampener layer sandwiched between said printing impact portion and said mass weight.

2. The printing device according to claim 1 wherein said mass weight is spaced from said printing impact portion.

3. The printing device according to claim 1 wherein said printing impact portion further includes a lower pivot portion for supporting said print hammer for pivotal movement of said printing impact portion.

4. The printing device according to claim 3 wherein said noise dampener layer is of an elastomeric material and said layer is adhesively cemented to said printing impact portion and said mass weight.

5. A printing device having a print element, a platen, a carrier supporting an impact printer mechanism for driving a selected character pad of said print element to print a character on an image print medium supported by said platen, and a print hammer for use in conjunction with said impact printer mechanism for decreasing the acoustic noise transmitted through said print hammer, said print hammer comprising:

an upper print portion having a pair of downwardly extending legs;

a lower pivot portion including means for supporting said print hammer for pivotal movement of said upper print portion and having a pair of upwardly extending legs; and a noise dampener member joining said upper print portion downwardly extending legs and said lower pivot portion upwardly extending legs.

6. A printing device having a print element, a platen, a carrier supporting an impact printer mechanism for driving a selected character pad of said print element to print a character on an image print medium supported by said platen, and a print hammer for use in said impact printer mechanism for decreasing the acoustic noise transmitted through said print hammer, said print hammer comprising:

an upper print portion;

a lower pivot portion including means for supporting said print hammer for pivotal movement of said upper print portion; and at least two molded noise damper members joining and encasing parts of said upper print portion and pats of said lower pivot portion.

7. The printing device according to claim 6 wherein said molded noise damper members encasing said parts of said upper print portion and parts of said lower pivot portion are of an elastomeric material.

8. The printing device according to claim 7 wherein said parts of said upper print portion and said parts of said lower pivot portion include opposed extending legs formed therein.

9. The printing device according to claim 8 wherein said legs in each of said portions are laterally spaced apart different distances.

10. The printing device according to claim 5 wherein said opposed extending legs of said upper print portion and said lower pivot portion are each spaced laterally apart from one another equal distances and longitudinally separated from each other.

11. The printing device according to claim 10 wherein said noise damper member is affixed to an outer leg surface of said opposed extending legs.

12. The printing device according to claim 11 wherein said noise damper member further includes a metal plate affixed to the outer surface of said noise damper member to provide a rigid structure.

13. A printing device having a print element, a platen, a carrier supporting an impact printer mechanism for driving a selected character pad of said print element to print a character on am image print medium supported by said platen, said impact printer mechanism comprising:

a print hammer;

a rotary drive means including a rotary member having an axis of rotation, and means coupled to said rotary member at a point of connection and to said print hammer for actuating said print hammer to cause printing, said point of connection of said means coupled to said rotary member moving concentrically about said axis of rotation of said rotary member;

said print hammer includes a printing impact portion including an outwardly directed anvil;

a mass weight including a plate having a surface projecting a plurality of letter spaces in a plane parallel to said platen and including having a maximum dimension in a direction perpendicular to said platen substantially behind said anvil; and a noise dampener layer sandwiched between said printing impact portion and said weight.

* * * * *